United States Patent [19]

Berst et al.

[11] 4,089,521

[45] May 16, 1978

[54] TENNIS STROKE TRAINER

[76] Inventors: Theodore H. Berst, 1214 S. Hamilton St.; Paul A. Meyers, 1415 West St., both of Lockport, Ill. 60441

[21] Appl. No.: 717,585

[22] Filed: Aug. 25, 1976

[51] Int. Cl.[2] ..... A63B 69/38

[52] U.S. Cl. ..... 273/29 A; 273/58 C

[58] Field of Search ..... 273/26 R, 26 A, 26 E, 273/58 C, 29 A, 95 A, 184 B, 185 D, 185 C, 97 R, 208, 200 B, 200 AB, 183 C, 186 B, 197 R, 197 A, 196, 198, 181 RC; 272/76, 77, 78

[56] References Cited

U.S. PATENT DOCUMENTS

| | | | |
|---|---|---|---|
| 2,713,487 | 7/1955 | Jaediker | 273/29 A |
| 3,341,200 | 9/1967 | Brandley | 273/95 A |
| 3,466,053 | 9/1969 | Whaley | 124/7 X |
| 3,731,926 | 5/1973 | Vincent | 273/29 A |
| 3,876,203 | 4/1975 | Gold | 273/29 A |
| 3,924,853 | 12/1975 | Schleeger | 273/29 A |

FOREIGN PATENT DOCUMENTS

| | | | |
|---|---|---|---|
| 276,589 | 6/1965 | Australia | 273/29 A |
| 183,146 | 7/1922 | United Kingdom | 273/200 B |

*Primary Examiner*—Richard C. Pinkham
*Assistant Examiner*—T. Brown
*Attorney, Agent, or Firm*—Clarence A. O'Brien; Harvey B. Jacobson

[57] ABSTRACT

A horizontally elongated base is provided and an upright standard has its lower end oscillatably supported from one end of the base for angular displacement about a horizontal axis extending transversely of the base with the standard swingable between an upstanding position and a generally horizontally disposed position with the upper free end of the standard swung downwardly toward the other end of the base. The standard is adjustable in length and the upper end portion thereof includes a reverse bend terminating downwardly in a horizontally outwardly projecting terminal end extending outwardly of the aforementioned one end of the base. The free end of the terminal end portion includes an endwise outwardly opening cup-shaped mount in which a tennis ball is seatingly secured. The end of the base remote from the end thereof from which the standard is oscillatably supported includes an elevated upwardly facing cushion portion against which the upper free end of the standard may abut when the standard is propelled to its generally horizontal position as a result of the tennis ball being struck by a tennis racket. Further, expansion spring structure is connected between the base and the standard for yielding biasing the latter from the horizontal position thereof toward the static vertical position thereof.

7 Claims, 7 Drawing Figures

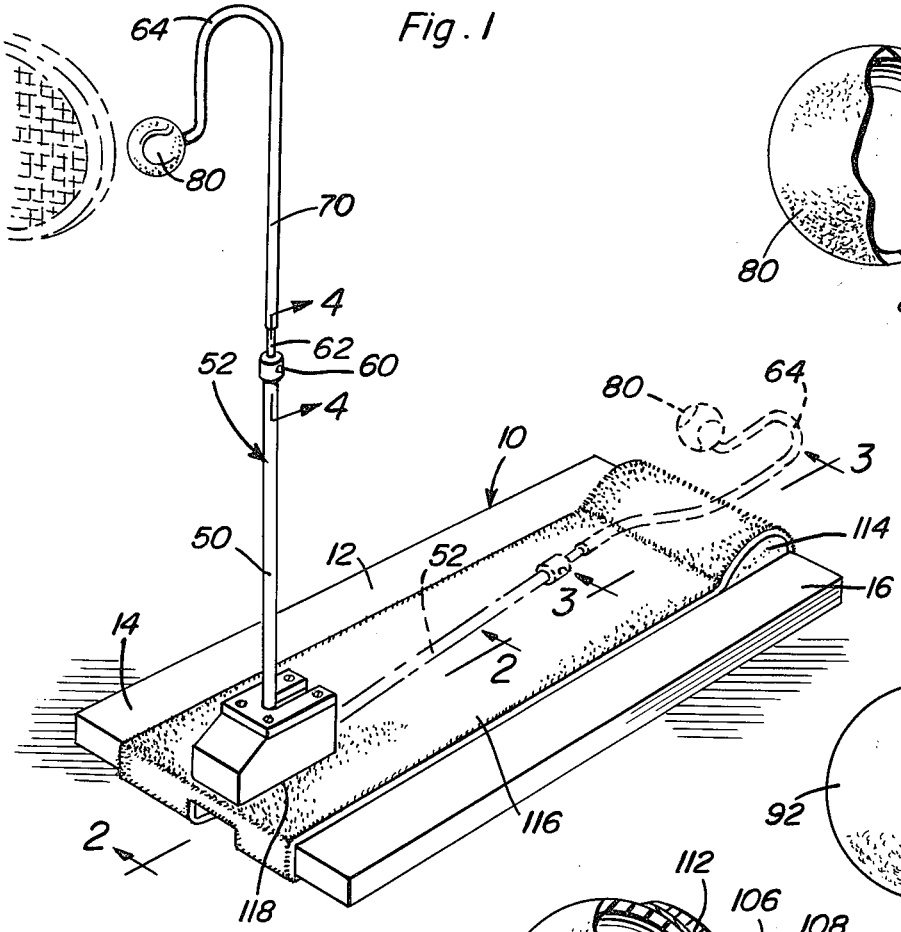
Fig. 1
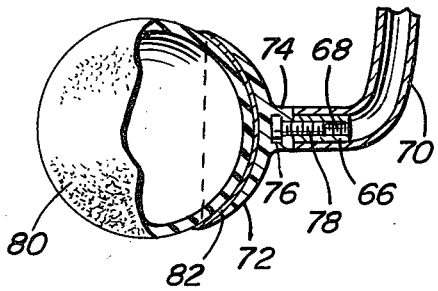
Fig. 5
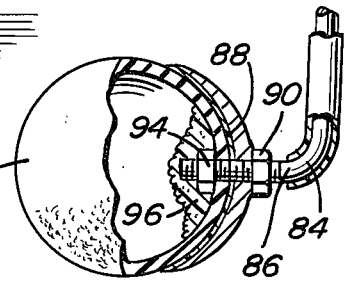
Fig. 6
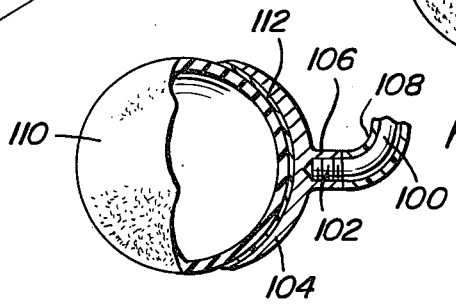
Fig. 7
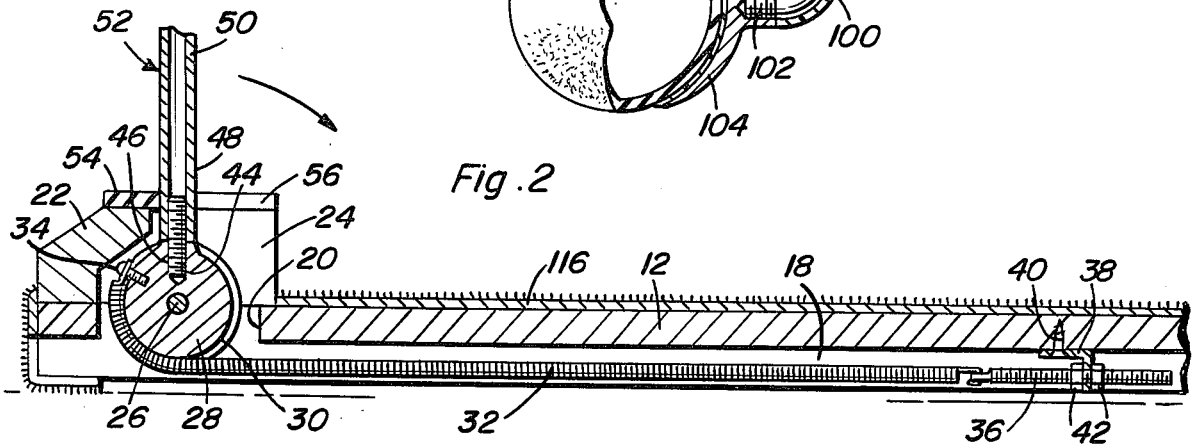
Fig. 2
Fig. 3
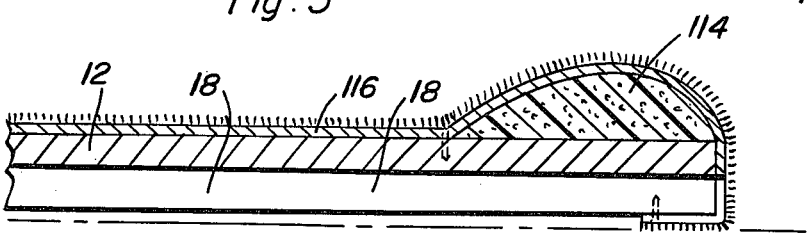
Fig. 4
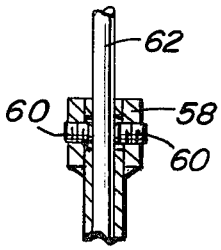

TENNIS STROKE TRAINER

BACKGROUND OF THE INVENTION

Various forms of appartuses have been heretofore provided in order to enable a person to practice tennis strokes. Although many of these apparatuses include specific features thereof which afford a particular advantage of operation, most previously known tennis stroke practice devices are not constructed in a manner whereby numerous advantages of operation and construction are afforded. Accordingly, a need exists for a device which will enable a person to practice tennis strokes and which is designed and constructed in a manner to afford numerous advantages of operation.

Examples of apparatuses including some of the general structural and operational features of the instant invention are disclosed in U.S. Pat. Nos. 2,272,765, 2,578,313, 2,713,487, 3,794,320, 3,876,203 and 3,924,853.

BRIEF DESCRIPTION OF THE INVENTION

The tennis stroke trainer of the instant invention includes a horizontally elongated base having the lower end of an upright standard pivotally secured thereto at one end of the base for oscillation of the standard relative to the base about an axis extending transversely of the base. The upper end of the standard includes a reversely bent and outwardly directed terminal end portion facing outwardly of the end of the base from which the standard is supported and the terminal end includes an endwise outwardly opening cup-shaped support in which a tennis ball is seatingly secured. In this manner, the tennis ball is spaced considerably outwardly of adjacent portions of the standard and sufficient clearance is provided around the tennis ball to enable the latter to be struck by a tennis racket, even in off-center relation, without the racket impacting with any portion of the standard. The standard is adjustable in vertical height so that the trainer may be adjusted for persons of different height and the end of the base remote from the end thereof from which the standard is oscillatably supported includes a raised upwardly facing cushion against which the upper end of the standard may impact upon the tennis ball being struck by a tennis racket and driving the upper end of the standard forwardly and downwardly toward the base. Further, an expansion spring is connected between the base and the standard for returning the latter to its static upright position after each impact of a tennis racket with the tennis ball of the trainer.

The main object of this invention is to provide a tennis trainer constructed in manner whereby a person using the trainer may efficiently practice his tennis stroke.

Another object of this invention, in accordance with the immediately preceding object, is to provide a tennis trainer including structure whereby the effective height of the object tennis ball may be adjusted;

Another object of this invention is to provide a tennis trainer including a stable base effective to maintain the trainer stationary in either an indoor location or an outdoor location.

Still another object of this invention is to provide a tennis trainer in accordance with the preceding objects and constructed in a manner whereby the supported object tennis ball is mounted in a position substantially eliminating any possibility of racket swung at the object ball contacting any portion of the standard of the tennis trainer.

Another very important object of this invention is to provide a tennis trainer including an adjustable spring for returning the standard of the trainer to its static upright position after each impact of a tennis racket with the standard mounted object tennis ball of the trainer.

Another object of this invention is to provide a tennis trainer in accordance with the preceding objects and including a standard having a tempered steel rod defining at least the upper portion of the standard of the trainer whereby the trainer may be used over long periods of time without incurring metal fatigue.

A further object of this invention is to provide a tennis trainer constructed in a manner so as to enable a conventional tennis ball to be used as the object ball.

Another important object of this invention is to provide a tennis stroke trainer which is portable and may be used in either an indoor location or an outdoor location.

A final object of this invention to be specifically enumerated herein is to provide a tennis stroke trainer in accordance with the preceding objects and which will conform to conventional forms of manufacture, be of simple construction and easy to use so as to provide a device that will be economically feasible, longlasting and relative trouble free in operation.

These together with other objects and advantages which will become subsequently apparent reside in the details of construction and operation as are fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the tennis stroke trainer of the instant invention;

FIG. 2 is an enlarged fragmentary longitudinal vertical sectional view taken substantially upon the plane indicated by the section line 2—2 of FIG. 1;

FIG. 3 is an enlarged longitudinal vertical sectional view taken substantially upon the plane indicated by the section line 3—3 of FIG. 1;

FIG. 4 is an enlarged fragmentary vertical sectional view taken substantially upon the plane indicated by the section line 4—4 of FIG. 1;

FIG. 5 is a fragmentary enlarged side elevational view of a first form of support standard upper terminal end with parts thereof being broken away and illustrated in vertical section in order to illustrate the manner in which a conventional tennis ball may be supported therefrom;

FIG. 6 is an enlarged fragmentary elevational view similar to FIG. 5 but illustrating a second form of standard upper terminal end and the manner of attaching a conventional tennis ball thereto;

FIG. 7 is an enlarged fragmentary elevational view similar to FIG. 5 illustrating a third f rm of standard upper terminal end and the manner of securing a conventional tennis ball thereto.

DETAILED DESCRIPTION OF THE INVENTION

Referring now more specifically to the drawings the numeral 10 generally designates the tennis stroke trainer of the instant invention. The trainer 10 includes a rectangular horizontally disposed base 12 having first and second ends 14 and 16. The underside of the base 12 is provided with a central longitudinally extending and downwardly opening channel 18 formed therein and opening endwise outwardly of the opposite ends of the base 12. The end 14 includes a vertical opening 20 formed therein which opens downwardly into the adjacent end of the channel 18 and a mounting block or housing 22 constructed of hard wood is secured to the upper surface of the base 12 over the opening 20. The housing 22 opens downwardly into the opening 20 and includes a slot 24 which opens upwardly and also horizontally toward the end 16 of the base 12.

A pivot shaft 26 is oscillatably supported from the housing 22 and extends across the hollow interior of the housing in registry with the slot 24. A disc 28 is mounted on the pivot shaft within the housing 22 and in registry with the slot 24 and the lower periphery of the disc 28 projects downwardly into the channel 18.

The disc 28 is provided with a peripheral groove 30 in which one end of an expansion spring 32 is anchored as at 34 and the spring 32 includes a threaded stud 36 on its other end secured through an apertured mount 38 anchored within the channel 18 adjacent the end 16 of the base 12 by means of a fastener 40. The shank 36 is secured through the mount 38 by means of jam nuts adjustably threaded on the mount on the shank 36 on opposite sides of the mount 38.

One end of a second threaded shank 44 is threadedly engaged in a blind radial bore 46 formed in the disc 28 and the other outer end of the shank 44 which projects into the slot 24 has the lower end 48 of the base section 50 of the standard referred to in general by the reference numeral 52 threaded thereover in order to mount the base section 50 and thus the standard 52 from the disc 28 for oscillation therewith.

A slotted abutment plate 54 is secured over the upper side of the mount 22 and the expansion spring 32 serves to yielding bias the disc 28 in a counterclockwise direction as viewed in FIG. 2 of the drawings to the static position thereof with the lower end 48 of the base section 50 of the standard 52 seated within the slot 56 formed in the plate 54. The slot 56 is co-extensive with the slot 24 and thus the standard 52 is swingable from the upright position thereof illustrated in solid lines in FIGS. 1 and 2 of the drawings to the generally horizontally disposed position thereof illustrated in phantom lines in FIG. 1.

The upper end of section 50 includes a tubular fitting 58 equipped with diametrically opposite set screws 60 and the standard 52 includes an upper section 62 whose lower end is slidingly telescoped downwardly into the upper end of section 50 and is secured in position by means of the set screws 60. Section 62 includes an upper end portion having a reverse bend 64 therein terminating downwardly in a horizontally directed terminal end 66 facing outwardly of the end 14 of the base 12. The terminal end 66 is provided with a threaded blind bore 68 and a substantial longitudinal extent of section 62 has a plastic sleeve 70 telescoped thereover which serves cosmetic purposes as well as to add rigidity to the section 62 and to deaden the sound of impact of a racket striking a ball supported from the upper end of section 62. From FIG. 5 of the drawings it may be seen that a cup-shaped mount 72 constructed of nylon or aluminum is provided and that the center of mount 72 includes a mounting boss 74 projecting outwardly of the convex side thereof. The boss 74 has the head 76 of a screw 78 embedded therein and screw 78 projects centrally outwardly of the outer extremity of boss 74 and is threadedly engaged in the bore 68 for retaining the mount 72 on the terminal end 66. A conventional tennis ball 80 is seated within the concave side of the mount 72 and secured therein by means of a strong glue layer 82.

With attention now invited more specifically to FIG. 6 of the drawings, there may be seen a modified form of upper section 84 which may be utilized in lieu of the section 62 and which includes an externally threaded terminal end 86 corresponding to the terminal end 66. A cup-shaped mount 88 corresponding to the mount 72 is provided and is centrally apertured to receive the terminal end 86 therethrough. A first jam nut 90 is threaded on the terminal end 86 on the convex side of the mount 88 and the free end of the terminal end 86 is secured through the side of a tennis ball 92 corresponding to the ball 80 seated in the concave side of the mount 88. A second jam nut 94 is threaded on the terminal end portion 86 within the tennis ball 92 and secured in position by means of a strong glue or adhesive 96 in which the nut 94 and the portion of the terminal end 86 within the ball 92 are embedded.

With attention now invited more specifically to FIG. 7 of the drawings, there may be seen a third form of upper section 100 which may also be used in lieu of the upper section 62. The upper section 100 includes a diametrically reduced externally threaded terminal end 102 and a cup-shaped mount 104 corresponding to the mount 72 and constructed of aluminum includes a boss 106 similar to the boss 74, but which includes a blind threaded bore 108 in which the diametrically reduced and threaded terminal end 102 is threadedly engaged. A conventional tennis ball 110 corresponding to the ball 80 is seated within the concave side of the mount 104 and secured therein by means of glue 112 corresponding to the glue 82.

With attention now invited more specifically to FIGS. 1 and 3 of the drawings it may be seen that the end 16 of the base 12 includes an impact absorbing cushion 114. The central longitudinal upper portion of the base 12 is carpeted with a section 116 of carpet and the section 116 extends the full length of the base 112, over the cushion 114 and has its opposite ends extended downwardly over the end edges of the base 12 and inwardly under the opposite ends 14 and 16 of the base 12. The section 116 of carpeting has an opening 118 formed therein upwardly through which the mount 22 projects and the opposite ends of the section 116 which extend inwardly the opposite ends 14 and 16 of the base 12 serve to offer a non-slip surface between the base 12 and a horizontal surface upon which the base 12 is disposed.

In operation, a person using the tennis stroke trainer 10 may stand adjacent the end 14 of the base 12 at one side thereof and swing a tennis racket into engagement with the ball 80. Upon impact of the tennis racket with the ball 80, the standard 52 will be sharply swung from the upright static position illustrated in solid lines in FIG. 1 to the generally horizontally disposed phantom line position thereof illustrated in FIG. 1 with the upper portion of the upper section 62 impacting with the cushion 114. Then, the spring 32 serves to return the standard 52 to its upright static position in readiness for the next stroke of the person using the trainer 10. Of course, the section 62 may be replaced by either the section 84 or the section 100.

The trainer 10 is of relatively lightweight construction, but the elongation of the base 12 and the opposite ends of the section 116 of carpeting projecting inwardly under the opposite ends of the base 12 enable the base 12 to remain stationary throughout utilization of the trainer 10. The sections 62, 84 and 100 are constructed of tempered metal whereby the material of which the upper section of the standard 52 is constructed and the contour of the upper section will absorb the initial shock of impact of a tennis racket with the supported tennis ball. Also, the tension of the spring 32 may be adjusted by adjustment of the jam nuts 42 and the elevated heighth of the ball 80 above the base 12 may be adjusted by loosening the set screws 60, adjusting the elevation of the section 62 as desired and then retightening the set screw 60.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A device for use with a tennis racket in improving tennis strokes, said device including a base, a standard having its lower end pivotally supported on said base for angular displacement about a horizontal axis and oscillation of said standard between a substantially upright static rest position and a generally horizontally disposed position, means operably connected between said base and said standard yieldingly biasing said standard toward said rest position, a rebounding portion of said base spaced laterally of said axis including a raised upwardly facing cushion against which the free end portion of said standard abuts when said standard is in said horizontal position, the upper end portion of said standard including a reversely bent downwardly directed portion terminating downwardly in a horizontally outwardly directed terminal end facing in a direction away from said standard opposite to the direction said cushion is spaced from said axis, said terminal end having a resilient object ball stationarily mounted thereon, said base being horizontally elongated and one end thereof has an upstanding opening formed therethrough, a hollow downwardly opening mount secured to said base over the upper end of said opening and having an upstanding slot formed therein opening upwardly through said mount and horizontally outwardly of the latter toward the other end of said base, said lower end of said standard projecting downwardly through said slot and said opening and being swingable through said slot, said cushion being mounted on said other end of said base, said means yieldingly biasing said standard toward said rest position including an expansion spring having one end anchored relative to said base and the other end operatively connected to said standard, said base defining an elongated downwardly opening and longitudinally extending channel opening into said upstanding opening at one end of said channel, said spring having a major portion thereof received in said channel.

2. The combination of claim 1 wherein said standard includes relatively longitudinally adjustable upper and lower sections and means operative to releasably retain said sections in relative adjust positions.

3. The combination of claim 1 wherein said lower end of said standard includes a peripherally grooved circular disc concentric with said axis and projecting through said opening and into said channel, said other end of said spring being seated in the peripheral groove of said disc and anchored therein.

4. The combination of claim 1 wherein said terminal end having a cup-shaped mount supported therefrom opening outwardly in the direction in which said terminal end faces, and an object ball seated and secured in said cup-shaped mount and projecting horizontally outwardly therefrom, said cup-shaped mount including a threaded shank projecting outwardly thereof and said terminal end includes a threaded blind base in which said shank is threadedly engaged.

5. The combination of claim 1 wherein said terminal end having a cup-shaped mount supported therefrom opening outwardly in the direction in which said terminal end faces, and an object ball seated and secured in said cup-shaped mount and projecting horizontally outwardly therefrom, said terminal end of said shank being externally threaded and said cup-shaped mount has a central opening formed therethrough through which said shank extends, said object ball being hollow and an opening in one side wall therein through which said shank extends, and a pair of threaded nuts threadedly disposed on said shank on the remote sides of said cup-shaped mount and said one side wall of said ball.

6. The combination of claim 1 wherein said terminal end having a cup-shaped mount supported therefrom opening outwardly in the direction in which said terminal end faces, and an object ball seated and secured in said cup-shaped mount and projecting horizontally outwardly therefrom, said terminal end including a diametrically reduced threaded shank, the side of said cup-shaped mount remote from said ball having a threaded blind bore formed therein in which said shank is threadedly engaged.

7. A device for use with a tennis racket in improving tennis strokes, said device including a base, a standard having its lower end pivotally supported on said base for angular displacement about a horizontal axis and oscillation of said standard between a substantially upright static rest position and a generally horizontally disposed position, means operably connected between said base and said standard yieldingly biasing said standard toward said rest position, a rebounding portion of said base spaced laterally of said axis including a raised upwardly facing cushion against which the free end portion of said standard abuts when said standard is in said horizontal position, the upper end portion of said standard including a reversely bent downwardly directed portion terminating downwardly in a horizontally outwardly directed terminal end facing in a direction away from said standard opposite to the direction said cushion is spaced from said axis, said terminal end having a resilient object ball stationarily mounted thereon, said terminal end having a cup-shaped mount supported therefrom opening outwardly in the direction in which said terminal end faces, and an object ball seated and secured in said cup-shaped mount projecting horizontally outwardly therefrom, said terminal end of said shank being externally threaded and said cup-shaped mount has a central opening formed therethrough through which said shank extends, said object ball being hollow and an opening in one side wall therein through which said shank extends, and a pair of threaded nuts threadedly disposed on said shank on the remote sides of said cup-shaped mount and said one side wall of said ball, a quantity of glue disposed within said ball and encapsulating the end of said shank projecting into said ball and the nut threaded thereon.

* * * * *